US005416947A

United States Patent [19]

Jaffe

[11] Patent Number: 5,416,947

[45] Date of Patent: May 23, 1995

[54] PORTABLE CLEANING DEVICE FOR CLOGGED FLUID CONDUITS

[76] Inventor: James S. Jaffe, 75 Grove Ave., Derby, Conn. 06418

[21] Appl. No.: 986,101

[22] Filed: Dec. 4, 1992

[51] Int. Cl.[6] ..... A47L 9/00

[52] U.S. Cl. ..... 15/330; 15/406

[58] Field of Search ..... 15/407, 330, 345, 346

[56] References Cited

U.S. PATENT DOCUMENTS

| | | | |
|---|---|---|---|
| 751,253 | 2/1904 | Brady | 15/406 |
| 1,556,417 | 10/1925 | Carroll . | |
| 1,769,061 | 7/1930 | Hitchcock | 15/406 |
| 2,039,177 | 4/1936 | MacKenzie | 15/406 |
| 2,056,018 | 9/1936 | Popp | 15/406 |
| 2,147,593 | 2/1939 | Bracken . | |
| 2,386,870 | 10/1945 | Lawton | 15/406 |
| 2,623,234 | 12/1952 | Brown | 15/330 |
| 2,889,006 | 6/1959 | Ortega et al. | 15/330 |
| 3,426,774 | 2/1969 | Conn . | |
| 3,879,771 | 4/1975 | Nakane . | |
| 4,919,154 | 4/1990 | Engle . | |
| 4,933,017 | 6/1990 | Brzoska | 15/330 |
| 5,007,444 | 4/1991 | Sundholm . | |
| 5,105,504 | 4/1992 | Brzoska | 15/330 |
| 5,249,311 | 10/1993 | Rau | 15/406 |

FOREIGN PATENT DOCUMENTS

| | | | |
|---|---|---|---|
| 1070560 | 6/1967 | United Kingdom | 15/406 |

*Primary Examiner*—Timothy F. Simone
*Assistant Examiner*—James F. Hook
*Attorney, Agent, or Firm*—Ware, Fressola, Van Der Sluys & Adolphson

[57] ABSTRACT

A disengageable, portable, self-contained fluid conduit cleaning device for unclogging fuel lines, plumbing lines or similar fluid conduits has a pneumatic pump, and a pressure delivery tank chamber. Controls alternatively connect the pump to supply either a pressure charge or a partial vacuum to the chamber. A delivery valve connects the chamber to the fluid conduit, to provide sudden pneumatic or hydraulic shocks to impact and break loose clogging material from the fluid conduit.

10 Claims, 2 Drawing Sheets

Figure 4:
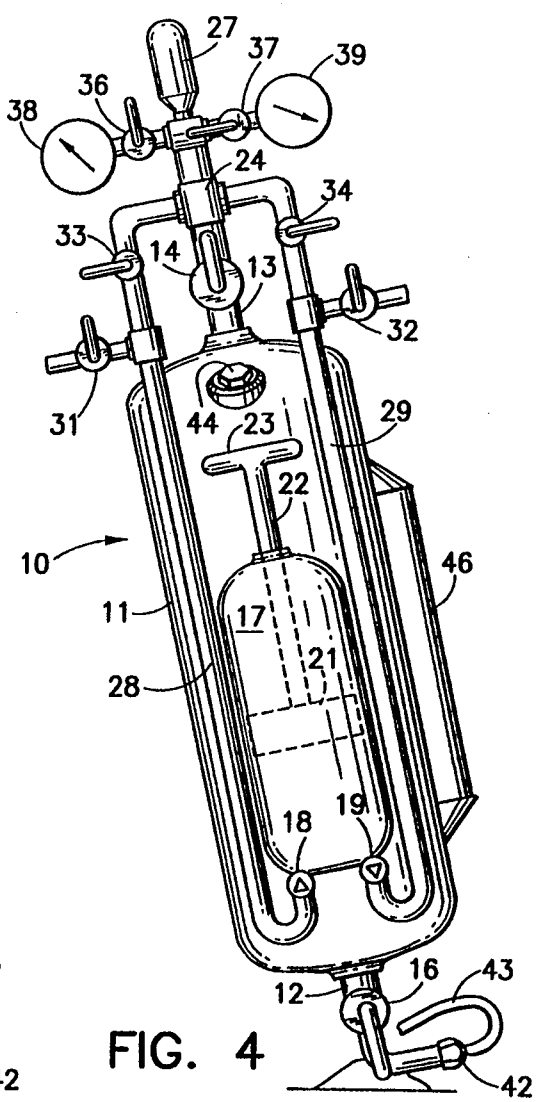

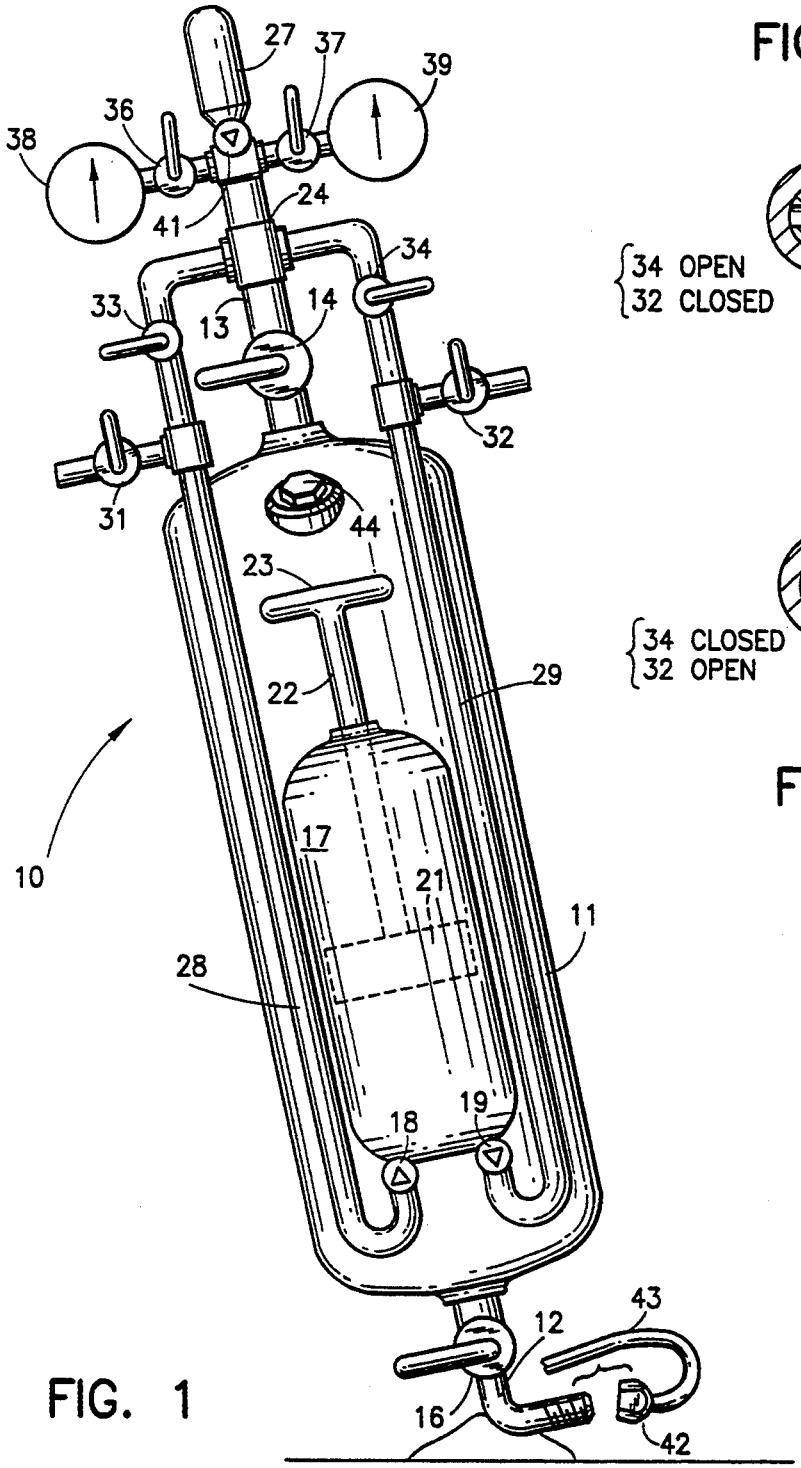
FIG. 1
FIG. 5
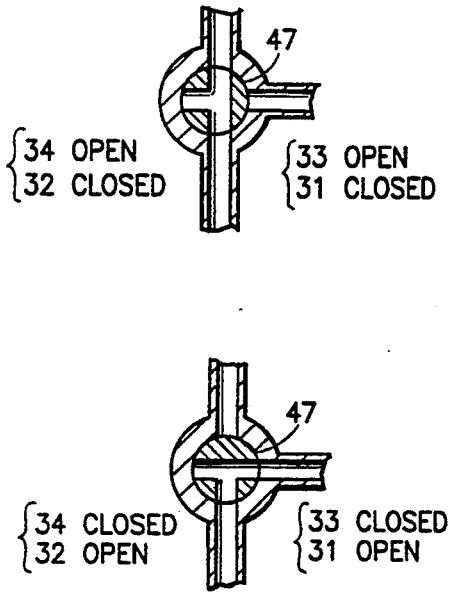
FIG. 6

PORTABLE CLEANING DEVICE FOR CLOGGED FLUID CONDUITS

FIELD OF THE INVENTION

This invention relates to cleaning devices for clogged fuel lines, water lines and similar fluid conduits which sometimes becomes clogged with sediment or foreign matter blocking the flow of fluid therethrough. More particularly, this invention relates to portable cleaning devices easily transported by a single service person from one site to the next and useful for clearing many different types of fluid line obstructions.

BACKGROUND OF THE INVENTION

Many different devices have been proposed for clearing clogged fuel lines and plumbing lines. For example, Carroll U.S. Pat. No. 1,556,417 employs a manual air pump to backflush an automobile fuel line and to blast compressed air forward through the carburetor. Conn U.S. Pat. No. 3,426,774 and. Nakane U.S. Pat. No. 3,879,771 both employ $CO_2$ cartridges that provide compressed gases to function as hydraulic rams, clearing blocked pipes or drains. Conn steps down the 750 psi cartridge pressure to between 60 and 100 psi in an accumulator cylinder 10 and then suddenly delivers that pressure to the clogged line. Bracken U.S. Pat. No. 2,147,593 applies physical hammer blows on a ram piston to deliver hydraulic blows to the clogged line. Engle U.S. Pat. No. 4,919,154 describes a combined pipe purging device which can deliver repeated physical shocks or repeated hydraulic shocks, and. can pump fluid into or out of the clogged system, or pump in chemical drain cleaners. Sundholm U.S. Pat. No. 5,007,444 combines liquid and gas for purging a clogged fuel line utilizing many short slugs of oil alternating with short bubbles of compressed air or nitrogen, all of which are first compressed and then suddenly decompressed, assertedly creating a forceful flushing pulse through the pipe system.

These prior patents indicate that different modes of delivering force to a conduit clog may be preferred in different circumstances. Compressed gas or the application of vacuum or a hydraulic shock, applying sudden pressure to fluid in the clogged conduit, have all been used in various situations, but these alternative pressure sources are not normally provided by the same equipment.

SUMMARY OF THE INVENTION

The portable conduit cleaning device of the present invention provides many different modes of force transmission, and all of these are available as convenient alternatives without moving the portable cleaning device from the site, and indeed without disconnecting it from the clogged conduit.

The basic components of the present invention are a delivery cylinder 11, a pneumatic pump capable of being connected to provide either compressed air or vacuum, a check-valved compressed gas pressure port which is adapted to receive a $CO_2$ cylinder mounted thereon whenever desired, and six selector valves mounted in connecting conduits, preferably ball valves for simple and convenient open-shut operation. Both the pneumatic pump and the selector valves are preferably manually operated, although electrically operated components may be used if desired. A pressure gauge and a vacuum gauge are preferably mounted on the device, and a threaded connecting port is provided at the lower end of the unit suitable for connection with standard piping fittings, such as the fittings normally connecting the delivery end of a fuel oil delivery conduit to the supply pump of an oil burner. Suitable adaptors may be employed to connect the threaded connecting port to any other fluid conduit requiring clearing.

A principal object of the invention is to produce conduit-cleaning "shock" forces, using vacuum or different levels of compressed gas pressure. A further object is to produce such shock forces utilizing a single clearing device, removably connected to the conduit to be cleared, for either pressure or vacuum operation. Still another object is to provide such a clearing device capable of fully manual operation, requiring no external power source.

Other objects of the invention will in part be obvious and will in part appear hereinafter.

The invention accordingly comprises the features of construction, combination of elements, and arrangement of parts which will be exemplified in the construction hereinafter set forth, and the scope of the invention will. be indicated in the claims.

THE DRAWINGS

Figure 3:
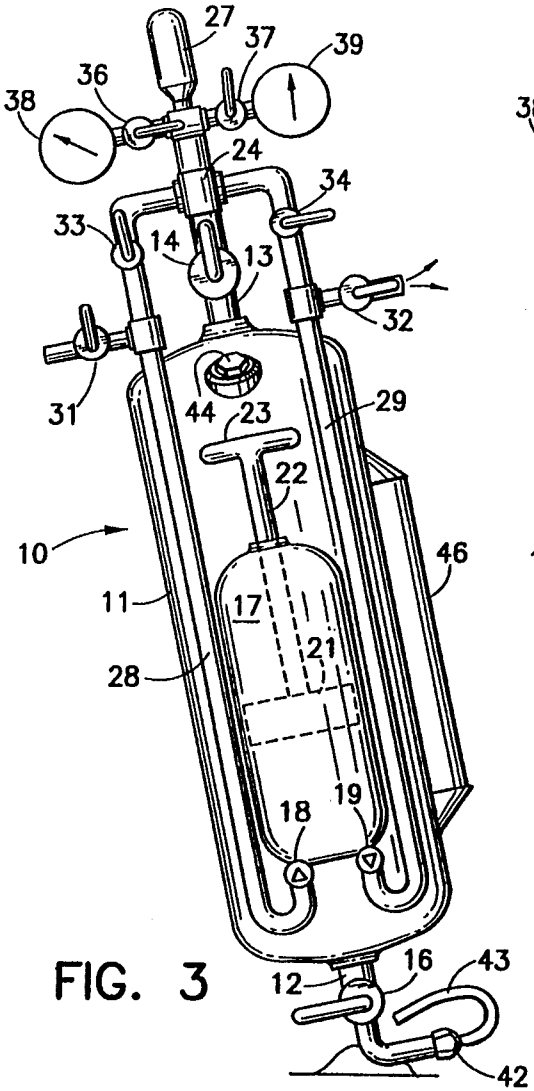
Figure 2:
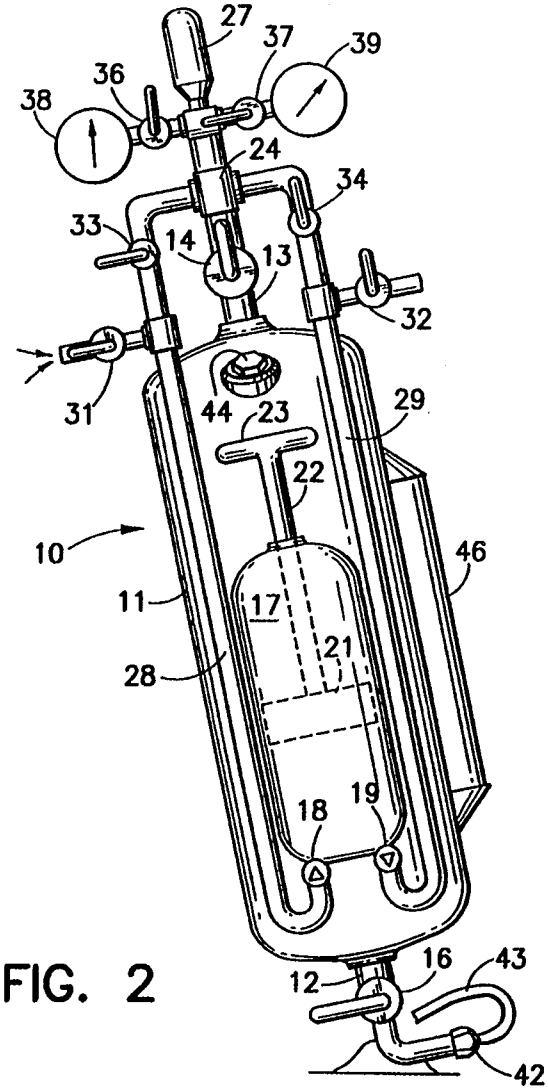

For a fuller understanding of the nature and objects of the invention, reference should be made to the following detailed description taken in connection with the accompanying drawings, in which:

FIG. 1 is a front elevation view of a portable conduit cleaning unit of the present invention in position ready for connection to a fuel oil delivery conduit and halving all of its six ball valves closed, with its pressure and vacuum gauge valves also being shown in closed position;

FIGS. 2, 3 and 4 are reduced scale front elevation views of the same device with its various valves shown in different positions required for different operating modes: FIG. 2 shows the device in its compressed gas arming mode, FIG. 3 shows the device in its vacuum arming mode and FIG. 4 in its hydraulic shock arming mode; each one of these FIGS. 2, 3 and 4 shows the delivery valve in its closed condition, ready to be opened for the sudden delivery of clearing force to the clogged conduit.

FIGS. 5 and 6 are fragmentary cross-sectional diagrams of combined three-way valve assemblies employed in a modified version of the invention.

BEST MODE FOR CARRYING OUT THE INVENTION

The various subassemblies or components comprising the portable conduit clearing unit 10 of the present invention are best seen in FIG. 1, where the central structural feature of the device 10 is an elongated delivery cylinder 11. having a delivery conduit 12 at its lower end and an entrance conduit 13 at its upper end. Each end of cylinder 11 provided with a valve, preferably a manual ball valve, the entrance ball valve 14 being provided at the upper end of the device and the delivery ball valve 16 being positioned at the lower end of the device. Mounted on the exterior of delivery cylinder 11 is a manual pneumatic piston pump cylinder 17 having an intake check valve 18 and a delivery check valve 19 at its lower end. Inside cylinder 17 is a pneumatic piston 21 connected by a piston rod 22 to an actuating pump handle 23.

At the upper end of the delivery cylinder 11, the entrance ball valve 14 is connected to a supply junction 24. Supply junction 24 is connected to a compressed gas supply conduit 26 surmounted by a suitable check-valve fitting for mounting a small $CO_2$ cartridge 27.

Also, two elongated conduits connect the supply junction 24 to the lower end of the pneumatic pump cylinder 17. These conduits are a vacuum conduit 28 and a pressure conduit 29. Conduit 28 is provided with a portal valve 31 and conduit 29 is provided with a portal valve 32 respectively leading to the external atmosphere. A blocking valve 33 in conduit 28 and a blocking valve 34 in conduit 29 are each interposed in its conduit between junction 24 and the portal valve. The upper end of the compressed gas supply conduit 26 is connected by isolation valves 36 and 37 respectively to a vacuum gauge 38 and a pressure gauge 39, and also through a check valve 41 to a threaded portal on which the compressed $CO_2$cartridge 27 may be threadedly engaged. Valves 31, 32, 33, 34, 36 and 37 are all preferably manual ball valves An examination of FIG. 1 will show that supply junction 24 can be totally isolated from all other parts of the system by closing ball valves 14, 33, 34, 36 and 37, since check valve 41 is normally closed except when $CO_2$ cartridge 27 has been installed. When utilizing the device of this invention in any one of its operating modes, the supply junction 24 will be connected to different parts of the device 10 by the operator to provide the different connections required.

Manual Pneumatic Pressure Mode

The manual pneumatic pressure mode of device 10 shown in FIG. 2 is characterized by the connection of the threaded end of delivery conduit 12 to the disconnected union 42 at the oil burner end of a fuel oil supply line 43, in which a clog has interrupted the oil burner operation. To place the portable cleaning device in its manual pneumatic pressure mode, valves 14, 31, 34 and 37 are moved to their open positions, with the other ball valves remaining closed. In these open positions, actuation of the pump handle 23 in reciprocating motion draws atmospheric air through vacuum intake portal valve 31 and vacuum conduit 28 by way of check valve 18 into the pneumatic cylinder 17 from which it is ejected under pressure through check valve 19 and pressure conduit 29 by way of open pressure ball valve 34 and supply junction 24 through entrance ball valve 14 into delivery cylinder 11. As atmospheric air is thus compressed through continuing reciprocation of pump handle 23, the pressure is built up in delivery cylinder 11 to any pressure level desired, as indicated on pressure gauge 39.

It will be noted that delivery ball valve 16 remains closed, so that compressed air from delivery cylinder 11 is not. delivered to fuel supply line 43 until a sufficient pressure head has been built up in the delivery cylinder 11. When this has been accomplished, the operator briskly opens delivery ball valve 16, and a surge of compressed air is thus applied through delivery conduit 12 and union 42 directly into the fuel supply line 43. This sudden application of pneumatic pressure may be repeated as often as desired until the clog has been driven backward along the fuel supply line 43 into the fuel tank.

When a water line or other fluid conduit is clogged, its proximal end may be connected by suitable adaptor to delivery conduit 12 of the device 10, and the same manual pneumatic pressure mode may be employed to deliver any desired number of repeated compressed air shocks into the fluid conduit to break up any clog accumulated therein, or to identify the clog as a blocked foot valve in a fuel tank.

Manual Vacuum Mode

The manual vacuum mode, illustrated in FIG. 3, is an alternative operating mode which may be employed if the foregoing manual pressure mode does not eliminate the clog. In the manual vacuum mode, the device 10 remains positioned with its delivery conduit 12 connected to the union 412 at the proximal end of the clogged fluid line 43, and ball valves 14, 32, 33 and 36 are now opened to place the device in the vacuum mode, ready to supply negative pressure to delivery cylinder 11. Actuation of pump handle 23 now draws air from the inside of delivery cylinder 11 through entrance valve 14 and the open vacuum blocking ball valve 33 by way of check valve 18 into the pump cylinder 17, from which it is expelled through check valve 19 and pressure conduit 29 via pressure portal valve 32 to the outside atmosphere. Continuing reciprocating actuation of pump handle 23 draws the vacuum in delivery cylinder 11. down to the desired vacuum level indicated on vacuum gauge 38, which is connected to the interior of delivery cylinder 11 by ball valve 14, supply junction 24 and the open vacuum gauge isolation ball valve 36. When the desired vacuum level is reached in delivery cylinder 11 delivery valve 16 may be opened briskly by the operator, producing a significant pressure differential on opposite sides of the clog in the fluid line 43, when the negative pressure in cylinder 11 is applied to the proximal side of the clog and the ambient pressure in the fuel tank, which is likely to be atmospheric pressure, is applied to the distal side of the clog. In many cases, this pressure differential will move the clog toward the union 42 and remove it from the fluid conduit 43.

This operation may be repeated as many times as desired.

When the conduit clogging material, sediment or other debris is drawn through delivery conduit 12 and delivery valve 16 into the delivery cylinder 11 it may require cleanout of the cylinder 11. This may be accomplished through the cleanout port 44 in the upper end of cylinder 11 after the delivery conduit 12 has been disconnected from the union 42 and compressed air, detergent or water or other liquids may be introduced at atmospheric pressure or under higher pressures through cleanout port 44 to flush such debris through valve 16 and delivery conduit 12 into a waste container for disposal.

Hydraulic Shock Loading Modes

Since relatively incompressible fuel, oil, water or other liquid may be employed to deliver a shock load to the clogged conduit. and may have more success in dislodging the clogging material in the conduit if the foregoing measures are not effective, the devices of the present invention are also well adapted to provide such hydraulic shock loads. In this mode of the device, the delivery valve 16 is first opened to connect delivery cylinder 11 directly to the clogged conduit through open valve 16. The other ball valves are maintained in the manual vacuum mode position shown in FIG. 3, and a vacuum drawn by reciprocation of pump handle 23 through vacuum check valve 18, vacuum conduit 28, open vacuum blocking ball valve 33 and open entrance valve 14 is drawn inside cylinder 11 with air pumped out of cylinder 11 being expelled by pump 17 through check valve 19, pressure conduit 29 and open pressure portal valve 32 to the outside atmosphere.

Negative pressure developed in cylinder 11 thus draws liquid from the fluid conduit 43 through delivery conduit 12 directly into the lower end of the cylinder 11. A sight glass 46 illustrated in FIG. 4 allows the operator to determine the level of fluid desired in cylinder 11.

When the liquid from conduit 43 has been drawn by the differential pressure through delivery conduit 16 into the lower end of delivery cylinder 11 and has reached the desired level therein in sight glass 46, the vacuum mode may be terminated by closing ball valves 16, 32, 33 and 36 and opening the ball valves required to supply increased pressure above the liquid entrapped in delivery cylinder 11, valves 31, 34 and 37 while also leaving entrance valve 14 open. In this configuration, as indicated in FIG. 2, reciprocating movement of pump handle 23 draws in atmospheric air through vacuum portal valve 31 and delivers it under pressure from pump cylinder 17 into the upper end of delivery cylinder 11. The pressure attained in the upper end of cylinder 11 is indicated on pressure gauge 39. When the desired pressure is reached, above the liquid entrapped in cylinder 11, a surge of virtually incompressible liquid in the reverse direction through the fluid conduit 43 can be produced by the operator, merely by briskly opening delivery ball valve 16.

Substantially higher pressures may be applied to create a more vigorous hydraulic pressure surge by applying the $CO_2$ cylinder 27 to deliver compressed gas to the upper end of delivery cylinder 11 while maintaining all of the ball valves closed except entrance ball valve 14 and pressure gauge isolation ball valve 37. The pressure supplied by the $CO_2$ cylinder is thus made available to deliver the entire charge of entrapped liquid from delivery cylinder 11 to the clogged liquid conduit 43 when delivery valve 16 is opened by the operator.

If desired, the $CO_2$ cylinder 27 may be employed to pressurize the delivery cylinder 11 without first partially filling it with liquid drawn from the liquid conduit 43. In addition, by charging the delivery cylinder 11 through the use oft $CO_2$ cylinder 27 and then closing entrance ball valve 14 to contain the charge of compressed gas therein, the spent $CO_2$ cylinder 27 may then be removed and another fresh $CO_2$ cylinder may be installed on check valve 41. The subsequent opening of entrance valve 14 then allows the new $CO_2$ cylinder to supplement the pressure already existing in delivery cylinder 11, providing an even greater compressed gas pressure ready for release through delivery valve 16 whenever desired.

The choice of which of the foregoing operating modes will be selected depends on the experience of the operator. The low pressure manual mode is normally the first mode to be utilized in order to determine whether the clogged conduit is merely blocked by dirt or has an inoperative foot valve in the tank connection. In the latter case, the application of the second operating mode applying a vacuum of 26 to 27 inches of mercury in a sudden vacuum shock may very well open a stuck foot valve and may draw clogged material through the line without causing any damage. The use of the hydraulic pressure mode with manual pressure or $CO_2$ cylinder maintains the connection with the clogged fluid conduit, avoiding any drips or spillage of liquid at the site, and utilizes the liquid in the conduit itself to transmit the pressure shock to the clog. The escape of carbon dioxide is relatively hairless, and no CFC refrigerants which might harm the ozone layer in the stratosphere are required.

The various preferred control valves are described as ball valves because of their economy and simplicity of operation, since the handle position readily confirms the valve position. However, other types of valves may be substituted if desired. For example, as shown in FIGS. 5 and 6, a three-way valve 47 having two angular limit positions performs the combined functions of valves 32–34 or valves 31–33 in alternately connecting one of the pump's check valves to junction 24 and the other to atmosphere, or vice versa. Also, pump 17 may be a manual pump, a foot-actuated pump, or an electric pump if desired, and some or all of the other valves may be electrical. solenoid valves, permitting "push-button" actuation.

The manually portable devices 10 of the present invention are small enough to be carried by the service operator in one hand, and are easily transported between service vehicles and job sites.

Thus, the usefulness and economic advantages of the conduit clearing devices of this invention in clearing fuel lines, hydraulic fluid lines and plumbing lines are believed to be highly significant.

It will thus be seen that the objects set forth above, and those made apparent from the preceding description, are efficiently attained and, since certain changes may be made in the above construction without departing from the scope oft the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A portable, self-contained fluid conduit cleaning device removable attachable to the open end of a clogged fluid conduit and having two alternatively selectable operating modes, a first pressure mode in which a charge of compressed gas is suddenly delivered to the conduit, and a second vacuum mode in which a charge of negative pressure is suddenly delivered to the conduit, comprising:

a pressure tank enclosing a hollow delivery chamber (11), a delivery conduit (12), connected by a delivery valve (16) to a lower portion of the delivery chamber (11), and having a free end provided with connection means for disengageably connecting the delivery conduit (12) to a proximal end (42) of a clogged fluid conduit (43) to be cleaned, a pneumatic pump (17) operatively connected in the vacuum mode to deliver negative air pressure to the pressure tank (11) creating a charge of negative pressure therein ready for sudden delivery via the delivery valve (16) and the delivery conduit (12) to the clogged conduit (43), and alternatively operatively connected in the vacuum mode to deliver positive air pressure to the pressure tank (11) creating a charge of positive pressure therein ready for sudden delivery via the delivery valve (16) and the delivery conduit (12) to the clogged conduit (43), and control means (14, 31; 32, 33, 34) operatively connected (24, 28, 29) to the pneumatic pump for governing the alternative selection of the operator's choice between the pressure mode and the vacuum mode and thus determining which of the two pressures positive pressure and negative pressure, is built up in the pressure tank, ready to be delivered to the delivery chamber and thence to the clogged fluid conduit by the operator upon command.

2. The conduit cleaning device defined in claim 1 wherein the control means include a plurality of valves interposed in conduits respectively connecting an intake portal and an outlet portal of the pneumatic pump to said hollow delivery chamber.

3. The conduit cleaning device defined in claim 2 wherein the plurality of valves are ball valves.

4. The conduit cleaning device defined in claim 2 wherein the plurality of valves include three-way valves.

5. A portable, self-contained fluid conduit cleaning device comprising:

a pressure tank enclosing a hollow delivery chamber (11), a delivery conduit (12) connected by a delivery valve (16) to a lower portion of the delivery chamber (11), a supply junction (24) connected by an entrance valve (14) to an upper portion of the delivery chamber (11), a pneumatic pump having an intake check valve (18) operatively connected by a vacuum conduit (28) to the supply junction (24), and also having a delivery outlet check valve (19) operatively connected by a pressure conduit (29) to said junction (24), said vacuum conduit and said pressure conduit each having a respective portal valve (31; 32) connecting the conduit to ambient atmosphere when open, and a respective blocking valve (33; 34) between the portal valve (31; 32) and the supply junction (24), with said delivery conduit (12) being provided with connection means disconnectably joining (42) the delivery conduit (12) to the proximal end of a clogged fluid conduit (43) to be cleaned, whereby accumulated sediment, debris or clogging material can be removed from the fluid conduit by positioning the valves to connect the pneumatic pump (17) to the delivery chamber (11) via the delivery outlet check valve (19) and through the open blocking valve (34) of the pressure conduit (29), while the delivery portal valve (32) is closed, to provide a charge of compressed air in the delivery chamber, while the vacuum conduit (28) is connected to ambient atmosphere via its open portal valve (31) while its closed blocking valve (33) isolates it from the supply junction (24); and alternatively by repositioning the valves to connect the pump (17) to the delivery chamber (11) via the intake check valve (18) and through the open blocking valve (33) of the vacuum conduit (28) to provide a partial vacuum in the delivery chamber (11) while the delivery outlet check valve (19) and the pressure conduit (29) are connected to ambient atmosphere via the open portal valve (32) in the pressure conduit (29) while its closed blocking valve (34) isolates it from the supply junction (24), offering the operator the choice between a compressed air surge and a vacuum surge briskly delivered from the hollow delivery chamber (11) to the clogged fluid conduit (43) by opening the delivery valve (16).

6. The fluid conduit cleaning device defined in claim 5 wherein the portal valve and adjacent blocking valve are combined in a unitary three-way valve in the vacuum conduit, and another unitary three-way valve in the pressure conduit.

7. The cleaning device defined in claim 5 wherein the delivery valve, the entrance valve, the portal valve and the blocking valve are all ball valves.

8. The cleaning device defined in claim 5, further including pressure gauge means operatively connected to the supply junction for displaying internal pressure inside the delivery chamber.

9. The cleaning device defined in claim 5, wherein the pneumatic pump and all of the valves excluding check valves are manually operable by the operator, requiring no external source of power for their actuation or operation.

10. The clearing device defined in claim 5, wherein the supply junction incorporates a fitting disengageably connectable to a standard compressed carbon dioxide storage cylinder.

* * * * *